US011757232B2

(12) United States Patent
Enger et al.

(10) Patent No.: US 11,757,232 B2
(45) Date of Patent: Sep. 12, 2023

(54) FORKLIFT CONNECTOR LOCKOUT

(71) Applicant: Brady Worldwide, Inc., Milwaukee, WI (US)

(72) Inventors: Andrew N. Enger, Muskego, WI (US); Alexis D. Morales, Chino Hills, CA (US)

(73) Assignee: Brady Worldwide, Inc., Milwaukee, WI (US)

( * ) Notice: Subject to any disclaimer, the term of this patent is extended or adjusted under 35 U.S.C. 154(b) by 109 days.

(21) Appl. No.: 17/605,176

(22) PCT Filed: Apr. 8, 2020

(86) PCT No.: PCT/US2020/027243
§ 371 (c)(1),
(2) Date: Oct. 20, 2021

(87) PCT Pub. No.: WO2020/219271
PCT Pub. Date: Oct. 29, 2020

(65) Prior Publication Data

US 2022/0190523 A1 Jun. 16, 2022

Related U.S. Application Data

(60) Provisional application No. 62/837,540, filed on Apr. 23, 2019.

(51) Int. Cl.

| | |
|---|---|
| ***H01R 13/639*** | (2006.01) |
| ***H01R 11/28*** | (2006.01) |
| ***H01R 13/447*** | (2006.01) |

(52) U.S. Cl.
CPC ..... *H01R 13/639* (2013.01); *H01R 11/281* (2013.01); *H01R 13/447* (2013.01)

(58) Field of Classification Search
CPC ... H01R 13/639; H01R 11/281; H01R 13/447
See application file for complete search history.

(56) References Cited

U.S. PATENT DOCUMENTS

| | | | | |
|---|---|---|---|---|
| 4,066,313 | A | 1/1978 | von dem Hagen | |
| 4,204,738 | A * | 5/1980 | Tillotson ..... | H01R 13/6392 439/369 |
| 4,448,469 | A | 5/1984 | Metzger | |

(Continued)

OTHER PUBLICATIONS

Anderson Power Products, SB 350 Lockout, https://www.andersonpower.com/us/en/shop/sbr350-lockout.html, Copyright 2020 Ideal Industries, Inc., 1 page.

(Continued)

*Primary Examiner* — Tho D Ta
(74) *Attorney, Agent, or Firm* — Quarles & Brady LLP

(57) ABSTRACT

A lockout assembly is configured to lockout a battery connector including a connector head connected to a wire, The lockout assembly includes a connector cover part and a sliding part. The connector cover part includes a cupped portion providing a cavity and a guide rail extending away from the cavity in which the cavity is dimensioned to receive an end of the connector head. The sliding part is dimensioned to slidably engage the guide rail and has a hooking foot configured to selectively engage the connector head opposite the cavity of the connector cover part.

20 Claims, 4 Drawing Sheets

(56) References Cited

U.S. PATENT DOCUMENTS

| | | | | |
|---|---|---|---|---|
| 4,652,069 | A | 3/1987 | Smith | |
| 4,679,873 | A | 7/1987 | Brackett, Jr. | |
| 4,721,475 | A | 1/1988 | Burke, Jr. | |
| 4,812,131 | A | 3/1989 | Sieverman | |
| 5,393,237 | A | 2/1995 | Roy et al. | |
| 5,782,648 | A * | 7/1998 | Peterson | H01R 13/6395 24/17 AP |
| 6,056,563 | A | 5/2000 | Betzler | |
| 7,207,826 | B1 * | 4/2007 | Yang | H01R 13/6395 439/373 |
| 7,927,126 | B1 * | 4/2011 | Bender | B01J 19/10 439/458 |
| 9,391,402 | B2 * | 7/2016 | Lin | H01R 13/6395 |
| 9,647,390 | B1 * | 5/2017 | Creato | H01R 13/6392 |
| 9,799,991 | B2 * | 10/2017 | Yi | H01R 13/6392 |
| 2003/0220002 | A1 | 11/2003 | Chen | |
| 2007/0114054 | A1 | 5/2007 | Le Mon | |

OTHER PUBLICATIONS

PCT International Search Report and Written Opinion, PCT/US2020/027243, dated Jul. 16, 2020, 12 pages.

European Patent Office, Extended European Search Report, Application No. 20796303.4, dated Mar. 31, 2023, 11 pages.

* cited by examiner

FORKLIFT CONNECTOR LOCKOUT

CROSS-REFERENCE TO RELATED APPLICATION

This application represents the U.S. national stage entry of International Application No. PCT/US2020/027243 filed Apr. 8, 2020, which claims the benefit of U.S. Provisional Application No. 62/837,540 entitled "Forklift Connector Lockout" filed on Apr. 23, 2019, which is incorporated by reference herein for all purposes.

FIELD OF INVENTION

This disclosure relates to lockout devices and, in particular, to lockout devices for use with connector heads, such as connector heads that may be plugged in to establish a circuit or electrical connection with a battery or other power source.

BACKGROUND

When maintaining or repairing equipment, workers often utilize lockout devices to isolate and secure one or more energy control points. Energy control points of concern are disconnected or otherwise placed in a safe configuration (e.g., placed in an "off" position) and lockout devices are placed on them in order to prevent those energy control points from being reconnected, turned back on, re-energized, or otherwise returned to an operational state while the equipment is being worked upon. After all the work is done, the lockout devices are removed and the energy isolation points can be returned to the energized or operational state.

SUMMARY

Many industrial and consumer vehicles, as well as other electrical equipment, utilize wired connectors and plugs. For examples, such plugs or connectors can be used to connect the terminals of a battery to the electrical system of the vehicle or equipment. As this constitutes a potential energy control point, there are situations in which the connector may need to be locked out. However, because connectors come in different sizes, such lockouts may need to be uniquely sized to the particular connector and/or can include multiple separate parts that may be easily separated from one another when the lockout is not installed.

Thus, improved lockouts for connector heads, such as those used to lockout the connector head for connection to the battery on forklifts or other battery-driven vehicles, are needed.

According to one aspect, a lockout assembly is provided that is configured to lockout a battery connector which includes a connector head connected to one or more wires. The lockout assembly includes a connector cover part having a cupped portion that provides a cavity and a guide rail extending away from the cavity. The cavity is dimensioned to receive the connector head. The lockout assembly also includes a sliding part dimensioned to slidably engage the guide rail. The sliding part has a hooking foot that is configured to selectively engage the connector head opposite the cavity of the connector cover part.

In some forms, the guide rail may have a cavity end and a stop end. The cupped portion may be positioned near the cavity end and a blocking feature—which can include a protrusion—may be positioned on the stop end. The blocking feature, such as the protrusion, can prevent the sliding part from disengaging with the guide rail after the sliding part is initially assembled with the connector cover part by sliding the sliding part onto the guide rail fully past the blocking feature.

In some forms, the hooking foot may be configured to selectively engage a first battery connector head size when the sliding part is slidably engaged with the guide rail in a first position along a length of the guide rail and to selectively engage a second battery connector head size when the sliding part is slidably engaged with the guide rail in a second position along the length of the guide rail that is different than the first position.

In some forms, the guide rail may include one or more guide rail apertures and the sliding part may include one or more sliding part apertures. At least one guide rail aperture may be alignable with at least one sliding part aperture in at least one position of the sliding part on the guide rail of the connector cover part.

In some forms, when the sliding part is slidably engaged with the guide rail such that at least one guide rail aperture aligns with at least one sliding part aperture, the hooking foot may be configured to engage a connector head having a pre-determined length.

In some forms, there may be multiple aligned positions of the sliding part along the guide rail in which at least one guide rail aperture aligns with at least one sliding part aperture, and in each of the multiple aligned positions of the sliding part, the hooking foot may be configured to engage one of multiple connector head lengths. That is to say, the lockout assembly may be structured to have various alignment positions for the apertures, with each alignment position corresponding to a particular pre-determined length for a corresponding connector head size so that the cavity and hooking foot are able to be discretely positioned in one of various positions to securely engage and lockout connector heads of the various predetermined sizes and lengths. A locking member, such as a padlock, may be attached in one of the positions of alignment of the apertures to maintain the relative positions of the connector cover part and the sliding part during the locking out of the connector head.

In some forms, when the connector head is received in the cavity of the cupped portion and the sliding part is slid to align one or more guide rail apertures with one or more sliding part apertures, the hooking foot may engage the connector head opposite the cavity of the cupped portion and the connector head may be constrained by the hooking foot from moving out of the cavity. In this way, a connector head may be prevented from being reconnected to a mating connector component as long as the lockout assembly is attached thereto.

In some forms, at least one guide rail aperture and at least one sliding part aperture may align when the sliding part is slidably engaged with the guide rail in a first position, and at least one guide rail aperture and at least one sliding part aperture may align when the sliding part is slidably engaged with the guide rail in a second position that is different than the first position.

In some forms, the guide rail may be T-shaped, the T-shape defining a fin, and the one or more guide rail apertures may be arranged along the fin.

In some forms, the hooking foot may include multiple feet.

In some forms, the hooking foot may extend back in the direction of the cavity, for example, to a terminal end or ends of the hooking foot.

In some forms, the sliding engagement of the sliding part on the guide rail may occur in a direction parallel to a length of the guide rail.

In some forms, the cavity may be concave and rectangular in shape. However, the shape of the cavity may be shaped in any event to correspond to the shape of the connector head to be locked out.

In some forms, the guide rail may be received centrally through the sliding part. In such forms, the guide rail and the sliding part may have surfaces that bear upon one another during sliding engagement with one another.

According to another aspect, a lockout assembly is configured to lockout a battery connector including a connector head connected to a wire. The lockout assembly include a connector cover part, a sliding part, and a guide rail. The connector cover part includes a cupped portion providing a cavity in which the cavity being dimensioned to receive an end of the connector head. The sliding part has a hooking foot and the sliding part is slideable relative to the connector cover part. The guide rail is attached to one of the connector cover part and the sliding part and the guide rail slidably engages the other one of the connector cover part and the sliding part not having the guide rail in order to permit the selectively engagement of the hooking foot on the sliding part with the connector head opposite the cavity of the connector cover part in which the connector head is receivable.

The aforementioned features of the lockout assembly of the first aspect of the lockout assembly are likewise contemplated as being usable with this lockout assembly according to the other aspect or modifiable as will be readily apparent based on the alternative arrangement of the components.

These and still other advantages of the invention will be apparent from the detailed description and drawings. What follows is merely a description of some preferred embodiments of the present invention. To assess the full scope of the invention, the claims should be looked to, as these preferred embodiments are not intended to be the only embodiments within the scope of the claims.

DETAILED DESCRIPTION

Figure 1:
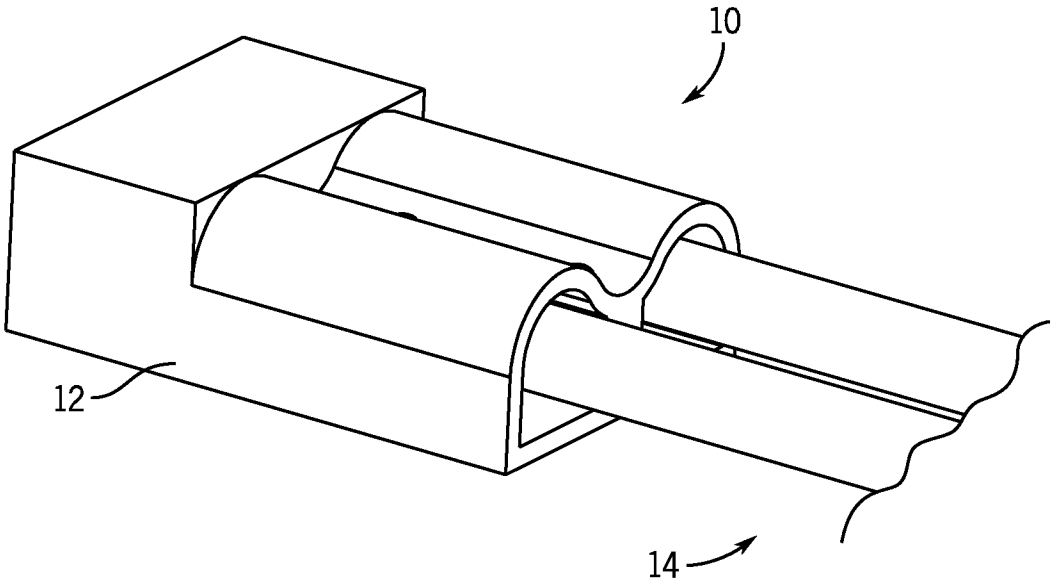
PRIOR ART FIG. 1
FIG. 1 is a perspective view of a conventional battery connector.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As used herein, unless otherwise specified or limited, "at least one of A, B, and C," and similar other phrases, are meant to indicate A, or B, or C, or any combination of A, B, and/or C. As such, this phrase, and similar other phrases can include single or multiple instances of A, B, and/or C, and, in the case that any of A, B, and/or C indicates a category of elements, single or multiple instances of any of the elements of the categories A, B, and/or C.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 3:
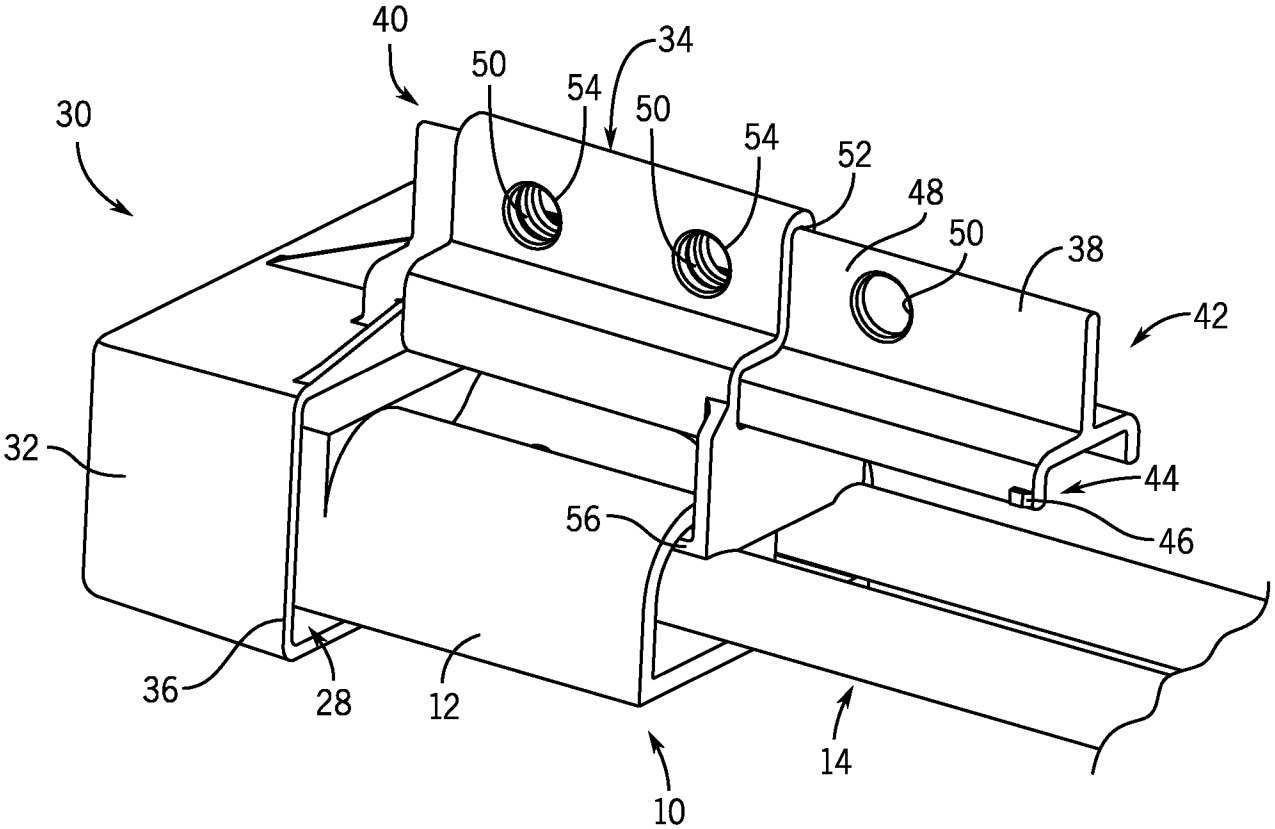
FIG. 3 is a perspective view of the lockout assembly of FIG. 2 engaging the conventional battery connector of FIG. 1 to lock out the battery connector.
Figure 4:
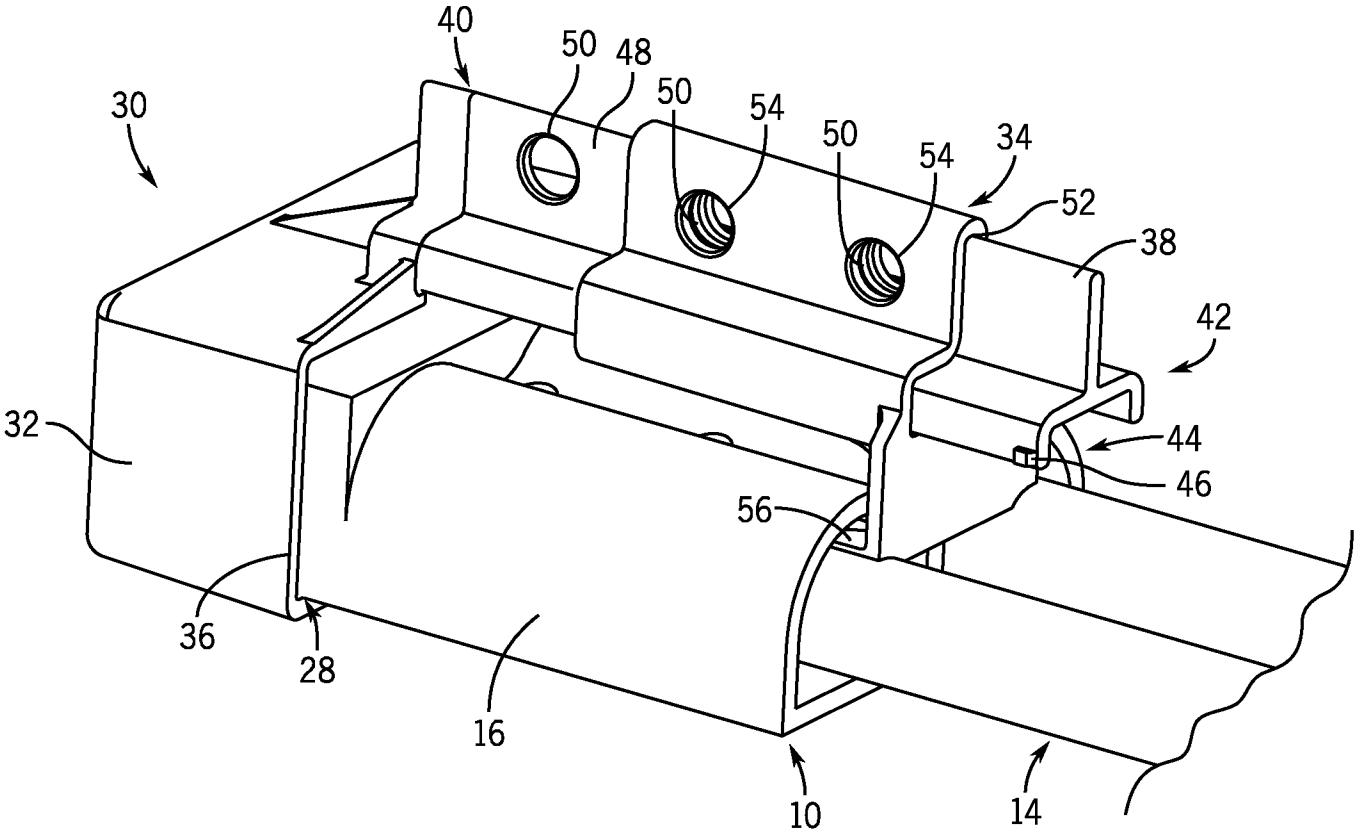
FIG. 4 is a perspective view of the lockout assembly of FIG. 2 engaging another conventional battery connector of a different and larger size and length than the battery connector of FIG. 1.

Referring first to FIG. 1, a conventional battery connector 10 is illustrated. The battery connector 10 can be used, for example, to link a battery to an electrical system of a utility vehicle such as a forklift. The battery connector 10 includes a connector head 12 and a pair of wires 14 that put the battery connector 10 in electrical communication with the terminals of a battery (not shown). Although only one size of connector head is shown in FIG. 1, it should be noted that battery connector heads can come in a variety of shapes and sizes. For example, two different size battery connectors are shown in FIGS. 3 and 4.

Because conventional connector heads are manufactured in many sizes to correspond with different equipment applications and connector sizes, it can be useful to provide an adjustable lockout assembly capable of isolating one or more sizes of connector heads of a single type. Such a lockout assembly is now described with reference to FIGS. 2 through 4.

Figure 2:
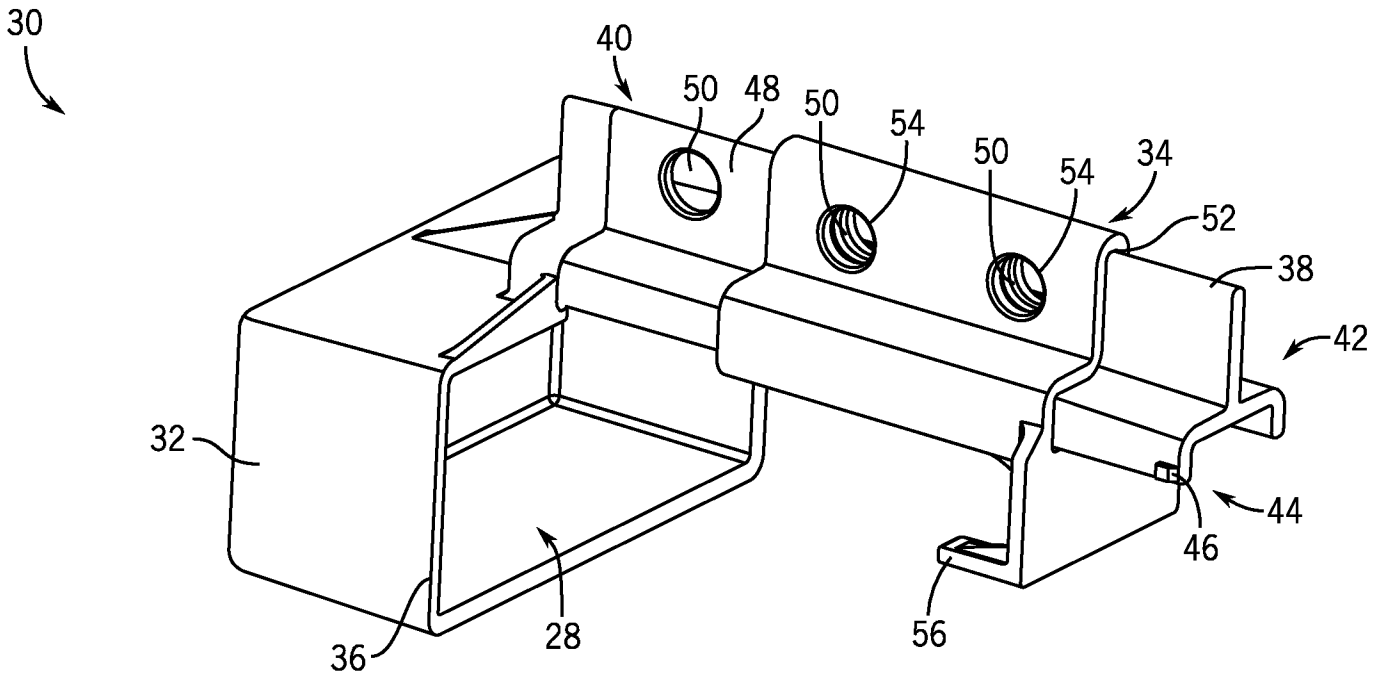
FIG. 2 is a perspective view of a lockout assembly apart from any battery connector.

With reference now being made to FIG. 2, a lockout assembly 30 for such a battery connector 10 is illustrated. The lockout assembly 30 has two parts which are lockable and adjustable with respect to one another including a connector cover part 32 and a sliding part 34. As will be described in greater detail below, the sliding part 34 is received on the connector cover part 32 and can be slid relative thereto between an open position in which the insertion of the battery connector 10 in the connector cover part 32 is permitted and a closed position in which the lockout assembly 30 can capture the battery connector 10 and, with the assistance of a locking device such as a padlock, secure the connector 10 from being inserted into a socket opening.

Looking first at the connector cover part 32, the connector cover part 32 includes a cupped portion 36 having a cavity 28 and a guide rail 38.

The cavity 28 formed by the cupped portion 36 is dimensioned to accommodate reception of the battery connector head 12 as shown in FIGS. 3 and 4. As illustrated, the cavity 28 is generally rectangular shaped so as to have a shape to match and receive the terminal end or connector head 12 of the battery connector 10, but may take other shapes based on the profile of the battery connector 10.

The guide rail 38, which is a generally T-shaped beam as illustrated, is attached to the cupped portion 36 at a peripheral rim of the cavity 28 and extends away therefrom. As such, the guide rail 38 can be said to extend from a cavity end 40 (that is, the end of the guide rail 38 proximate the cupped portion 36 defining the cavity 28) to a stop end 42 at the opposite free end of the guide rail 38, with the stop end 42 being so named because it can include a stop or blocking feature 44 that delimits the range of motion of the sliding part 34 on the guide rail 38. As illustrated, the blocking feature 44 is a protrusion 46 that is designed to permit only the one-way insertion of the sliding part 34 onto the guide rail 38, but to prohibit the removal of the sliding part 34 therefrom once the lockout assembly 30 is assembled. This can be achieved by having a tapered ramp on the stop end-facing side of the protrusion 46 and a stop surface on the cavity end-facing side of the protrusion 46 that is nearly perpendicular to the direction of extension of the guide rail 38, for example.

Rather than a shaped protrusion, the blocking feature 44 could also be any number of one-way mechanical coupling arrangements. For example, the blocking feature could be a cantilever beam that when at rest extends away from a surface at a shallow angle, flattens against the surface as the sliding part is passed over it in one direction, and springs up to prevent backward movement of the sliding part beyond it. This blocking feature could utilize the inherent elasticity of one or both of the engaging parts, for example, or may involve separate mechanical movable elements. As another example, the blocking feature could be a button spring clip similar to those used in telescoping, adjustable devices such as crutches. Still yet, it should be appreciated that the blocking feature might be present on the guide rail, the sliding part, or both. In any event, the blocking feature 44 should prevent decoupling of the sliding part 34 and the connector cover part 32, through any of the configurations described above or other configurations.

As shown in FIG. 2, the guide rail 38 can be T-shaped to define a fin 48 extending along the upper surface of the guide rail 38. Such shape can help strengthen and prevent torsion of the guide rail 38 as well as provide surfaces and structure for robust attachment of the guide rail 38 to the cupped portion 36, for the support of the blocking features 44, and for the placement of spaced guide rail apertures 50 along the guide rail 38. Among other things, this guide rail 38 serves as a track for the sliding part 34.

Although FIG. 2 illustrates the lockout assembly 30 having a T-shaped guide rail 38 and circular guide rail apertures 50, some embodiments provide other geometric configurations such as an H-shaped guide rail or rectangular guide rail apertures. As long as sliding part 34 is formed in a shape with an opening corresponding to the guide rail 38 that allows slideable engagement of the sliding part 34 with the guide rail 38 in multiple positions, the shape of guide rail 38 can be any elongated shape that allows linear translation.

Turning now to sliding part 34, sliding part 34 is dimensioned to slidably engage the guide rail 38 and, in particular, to provide linear translation of the sliding part 34 along the guide rail 38. For example, if the guide rail 38 is T-shaped, then the sliding part 34 will have a corresponding T-shaped bore 52 configured to receive the guide rail 38 with the two bearing upon one another during sliding engagement with one another.

The sliding part 34 also includes hooking feet 56 on the stop end side of the sliding part 34. These hooking feet 56 curve back towards the cupped portion 36 of the connector cover part 32 and are placed for engagement with the wall of the connector head on the side of the connector head that receives the wires.

The sliding part 34 further includes one or more sliding part apertures 54 which are alignable with one or more of the guide rail apertures 50 of the connector cover part 32. When such apertures on both parts align, a padlock or other locking device might be received therethrough to temporarily lock the connector cover part 32 and the sliding part 34 in relative positions with respect to one another. When there are multiple aperture on one or both of the parts 32 and 34, this also permits a variety of different discrete lengths between the bottom of the cavity 28 of the cupped portion 36 and the hooking feet 56 to accommodate different discrete lengths of connector heads therein.

In use, the lockout assembly 30 covers and electrically isolates a connector head 12, 16, as shown in FIGS. 3-4, respectively. The connector head 12, 16 is removed from the equipment being powered by the battery (not shown), the connector head 12, 16 is then received into the cavity 28 of the cupped portion 36 of the connector cover part 32, and the sliding part 34 is moved along the guide rail 38 until the hooking feet 56 engage the connector head 12, 16. At least one sliding part aperture 54 is arranged to align with at least one guide rail aperture 50 when the hooking feet 56 engage the connector head 12, 16. Thereafter, an object (for example, a padlock or zip-tie) can be threaded through the apertures 50, 54 that are in alignment with one another to secure the connector head 12 into the cavity 28.

FIGS. 3-4 illustrate the lockout assembly in use with two different connector heads 12, 16, each a different size with a different length. For both connector heads 12, 16, the hooking feet 56 extend from the sliding part 34 to hook into the outer casing of the connector heads 12, 16, in between the outer casing and the wire 14. As shown, lockout assembly 30 can secure at least two different connector head 12, 16 sizes. This is accomplished by the relative positions of the cupped portion 36, hooking feet 56, guide rail apertures 50, and sliding part apertures 54 and these features may be dimensioned differently or duplicated or arranged to create the desired spacing effect.

Once the connector head 12, 16 is received into the cavity 28 of the cupped portion 36, the sliding part 34 can have multiple possible positions (shown in FIG. 3 and FIG. 4) relative to the connector cover part 32 in which at least one sliding part aperture 54 and at least one guide rail aperture 50 are aligned and, simultaneously, the hooking feet 56 engage the connector head 12, 16. Therefore, one lockout assembly 30 embodiment can effectively cover and provide lockout capability for multiple connector head 12, 16 sizes or lengths.

While the illustrated embodiment shows two discrete positions, in some embodiments, at least one guide rail aperture 50 and at least one sliding part aperture 54 can align in three or more relative positions of sliding part 34 with respect to guide rail 3, so that the hooking feet 56 can engage three or more connector head lengths.

It is also contemplated that variations may be made to this illustrated design including possible reversal of parts. For example, it is contemplated that the guide rail could be made part of the sliding part and support the hooking feet, while the connector cover part may be provided with an opening that receives the guide rail and permits travel of the guide rail thereto. In such case, all such structure described herein (for example, stop surfaces, aligning apertures and so forth) can be employed in this modified structure, although some features, such as the stop or blocking feature, for example, may need to be positioned on the opposite end of the guide rail based on the reversals.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto.

What is claimed is:

1. A lockout assembly configured to lockout a battery connector including a connector head connected to a wire, the lockout assembly comprising:

a connector cover part including a cupped portion providing a cavity and a guide rail extending away from the cavity, the cavity being dimensioned to receive an end of the connector head; and a sliding part dimensioned to slidably engage the guide rail and having a hooking foot, the hooking foot configured to selectively engage the connector head opposite the cavity of the connector cover part;

wherein the guide rail has a cavity end and a stop end with the cupped portion being positioned near the cavity end and a blocking feature being positioned on the stop end including a protrusion and wherein the blocking feature prevents the sliding part from disengaging with the guide rail after the sliding part is assembled with the connector cover part by sliding the sliding part onto the guide rail fully past the blocking feature.

2. The lockout assembly of claim 1, wherein the hooking foot is configured to selectively engage a first battery connector head size when the sliding part is slidably engaged with the guide rail in a first position along a length of the guide rail, and wherein the at least one hooking foot is configured to selectively engage a second battery connector head size when the sliding part is slidably engaged with the guide rail in a second position along the length of the guide rail that is different than the first position.

3. The lockout assembly of claim 1, wherein the hooking foot includes multiple feet.

4. The lockout assembly of claim 1, wherein the hooking foot extends back in the direction of the cavity.

5. The lockout assembly of claim 1, wherein the sliding engagement of the sliding part on the guide rail occurs in a direction parallel to a length of the guide rail.

6. The lockout assembly of claim 1, wherein the cavity is concave and rectangular in shape.

7. The lockout assembly of claim 1, wherein the guide rail includes one or more guide rail apertures and the sliding part includes one or more sliding part apertures in which at least one guide rail aperture is alignable with at least one sliding part aperture in at least one position of the sliding part on the guide rail of the connector cover part.

8. The lockout assembly of claim 7, wherein, when the sliding part is slidably engaged with the guide rail such that at least one guide rail aperture aligns with at least one sliding part aperture, the hooking foot is configured to engage a connector head having a pre-determined length.

9. The lockout assembly of claim 7, wherein there are multiple aligned positions of the sliding part along the guide rail in which at least one guide rail aperture aligns with at least one sliding part aperture and, in each of the multiple aligned positions of the sliding part, the hooking foot is configured to engage a corresponding one of multiple connector head lengths.

10. The lockout assembly of claim 7, when the connector head is received in the cavity of the cupped portion and the sliding part is slid to align one or more guide rail apertures with one or more sliding part apertures, the hooking foot engages the connector head opposite the cavity of the cupped portion and the connector head is constrained by the hooking foot from moving out of the cavity.

11. The lockout assembly of claim 7, wherein at least one guide rail aperture and at least one sliding part aperture align when the sliding part is slidably engaged with the guide rail in a first position, and wherein at least one guide rail aperture and at least one sliding part aperture align when the sliding part is slidably engaged with the guide rail in a second position that is different than the first position.

12. The lockout assembly of claim 7, wherein the guide rail is T-shaped, the T-shape defining a fin, the one or more guide rail apertures being arranged along the fin.

13. A lockout assembly configured to lockout a battery connector including a connector head connected to a wire, the lockout assembly comprising:

a connector cover part including a cupped portion providing a cavity and a guide rail extending away from the cavity, the cavity being dimensioned to receive an end of the connector head; and a sliding part dimensioned to slidably engage the guide rail and having a hooking foot, the hooking foot configured to selectively engage the connector head opposite the cavity of the connector cover part;

wherein the guide rail is received centrally through the sliding part and wherein the guide rail and the sliding part have surfaces that bear upon one another during sliding engagement with one another.

14. The lockout assembly of claim 13, wherein the sliding engagement of the sliding part on the guide rail occurs in a direction parallel to a length of the guide rail.

15. The lockout assembly of claim 13, wherein the hooking foot extends back in the direction of the cavity.

16. The lockout assembly of claim 13, wherein the hooking foot is configured to selectively engage a first battery connector head size when the sliding part is slidably engaged with the guide rail in a first position along a length of the guide rail, and wherein the at least one hooking foot is configured to selectively engage a second battery connector head size when the sliding part is slidably engaged with the guide rail in a second position along the length of the guide rail that is different than the first position.

17. The lockout assembly of claim 13, wherein the guide rail is T-shaped including a fin.

18. The lockout assembly of claim 17, wherein the fin includes one or more guide rail apertures.

19. The lockout assembly of claim 18, wherein the sliding part includes one or more sliding part apertures and wherein at least one of the one or more guide rail apertures is alignable with at least one of the one or more sliding part apertures in at least one position of the sliding part on the guide rail of the connector cover part.

20. A lockout assembly configured to lockout a battery connector including a connector head connected to a wire, the lockout assembly comprising:

a connector cover part including a cupped portion providing a cavity, the cavity being dimensioned to receive an end of the connector head;

a sliding part having a hooking foot and being slideable relative to the connector cover part; and a guide rail attached to one of the connector cover part and the sliding part in which the guide rail slidably engages the other one of the connector cover part and the sliding part not having the guide rail to permit selectively engagement of the hooking foot on the sliding part with the connector head opposite the cavity of the connector cover part;

wherein the guide rail includes one or more guide rail apertures and the sliding part includes one or more sliding part apertures in which at least one guide rail aperture is alignable with at least one sliding part aperture in at least one position of the sliding part on the guide rail of the connector cover part;

wherein the guide rail is T-shaped, the T-shape defining a fin, the one or more guide rail apertures being arranged along the fin.

* * * * *